US008141563B2

(12) United States Patent
De Masi, Sr.

(10) Patent No.: US 8,141,563 B2
(45) Date of Patent: Mar. 27, 2012

(54) TOOTH BRUSH COMBINATION

(76) Inventor: Douglas D. De Masi, Sr., Hopewell Junction, NY (US)

( * ) Notice: Subject to any disclaimer, the term of this patent is extended or adjusted under 35 U.S.C. 154(b) by 1162 days.

(21) Appl. No.: 11/323,926

(22) Filed: Jan. 3, 2006

(65) Prior Publication Data

US 2007/0151575 A1 Jul. 5, 2007

(51) Int. Cl.
*A45D 44/18* (2006.01)

(52) U.S. Cl. ..... 132/309

(58) Field of Classification Search ..... 132/321, 132/323–324, 328–329, 308, 309; 15/167.1
See application file for complete search history.

(56) References Cited

U.S. PATENT DOCUMENTS

| | | | | |
|---|---|---|---|---|
| 5,213,428 | A * | 5/1993 | Salman | 401/7 |
| 5,742,971 | A * | 4/1998 | Salinger | 15/167.1 |
| 5,819,765 | A * | 10/1998 | Mittiga | 132/309 |
| 5,909,739 | A * | 6/1999 | Masrour-Rad | 132/308 |
| 6,004,059 | A * | 12/1999 | Zaccaria | 401/268 |
| 6,119,296 | A * | 9/2000 | Noe et al. | 15/104.94 |
| 6,349,445 | B1 * | 2/2002 | Mackay et al. | 15/167.1 |
| 6,772,770 | B1 * | 8/2004 | Williams, Sr. | 132/309 |
| 7,073,225 | B1 * | 7/2006 | Ford | 15/167.2 |
| 2002/0100134 | A1 * | 8/2002 | Dunn et al. | 15/167.1 |
| 2004/0040571 | A1 * | 3/2004 | Williams et al. | 132/309 |
| 2004/0134007 | A1 * | 7/2004 | Davies | 15/110 |
| 2004/0163979 | A1 * | 8/2004 | Bender et al. | 206/361 |

FOREIGN PATENT DOCUMENTS

DE 202005003517 * 7/2005

OTHER PUBLICATIONS

Translation of DE 202005003517.*

* cited by examiner

*Primary Examiner* — Todd Manahan
*Assistant Examiner* — Brianne Kalach

(57) ABSTRACT

This new and improved tooth brush combination is all one would ever need, the simple design on how and why the rotating flossing head is the only moving part and its simple, to lock in to place when in use and very easy to change when needed, and its location is on the tooth brush bristle head its self, and when not in use the rotating head will simply lay flat down, locks in to place on the tong cleaning section on the back of the tooth brush head, and when brushing your teeth, you will never know that there is a rotating flossing head. And the tooth brush bristle have a special design, with a spring pulling action and little barbs along the bristles that have a natural pulling force so the food and debris are more efficiently pulled from between your teeth and gum area, and all these combinations combined are not by the handle at all, this is the most efficient and friendly germ prevention hygienic tooth brush ever.

2 Claims, 1 Drawing Sheet

TOOTH BRUSH COMBINATION

FIELD OF THE INVENTION

The tooth brush combination of the present invention will provide a user friendly device to fight against tooth decay and gum disease by being equipped with an easy to use sanitary flossing means and tongue cleaner.

BACKGROUND OF THE INVENTION

The current state of the art with respect to combination toothbrushes and flossing devices can be shown by US Publications to Hohlbein (US PGPUB #2005/0210612); Wagstaff (US PGPUB #2005/0210613) and Mason (U.S. Pat. No. 1,537,853).

All of these tongue cleaners have the same design and pattern with little or no changes made to help the user or even a feature to clean the tongue better.

Many different tooth brushes have a flossing device located at the end of the brushing handle. This arrangement creates a situation where there is always dirty water contamination on the device from using the flossing device and/or brushing device that will drip and spill over onto the opposite end and the person will again put the wet dripping end in to their mouth along with all the germs from their hands and the dirty water.

Lai (US PGPUB #2004/0079384) is a different type of combination cleaning device, however it is battery powered and has many moving parts with many areas that would have to be dried out before use and then there would be an enormous amount of time required in just changing the different heads and the cleaning of the different parts to help keep the germs from spreading.

Then there are the separate flossing devices that haven't really changed over the years: Dougan (US PGPUB #2003/0098037), Ochs (US PGPUB #2004/0163666), and Ochs (US PGPUB #2005/0205107). These do not allow for comprehensive cleaning of the mouth.

The combined flossing and brushing elements above suffer from sanitary drawbacks where the flossing end would always get wet after the use of the brushing end and vice versa. The user would then have two wet ends and the germs would spread even faster from one end to the other end. There is a need to provide the user with a solution that would allow for comprehensive cleaning of the mouth, but not allow for such rapid spreading of germs between uses.

A Patent Publication of Williams Sr. (US PGPUB #2004/0040571) discloses a combination tooth brush and flossing device, however provides it with many different moving parts that are dependent on each other. If one part jams or breaks it prevents the rest of the device from being fully functional and must be discarded.

SUMMARY OF THE INVENTION

The present invention is a solution to the aforementioned problems that provides for a combination toothbrush, tongue cleaner and flossing device that is more hygienic and facilitates ease of use.

When using this invention the flossing device is on the same side of the handle as the tooth brush and tongue scraper, allowing for a more sanitary tooth brush. By not requiring as many moving parts as the prior art it does not provide for more surface area for moisture retention and germ growth, and additionally makes the device simpler to use.

The tooth brush combination solves the problem of removing the food debris between your teeth, along with all the germs that are left behind on your tongue, teeth and gums in a more sanitary manner. All this debris is removed in order to help eliminate sickness and to promote a healthier mouth, teeth, gums, tongue, along with your beautiful smile.

DETAILED DESCRIPTION OF THE DRAWINGS

Figure 2:
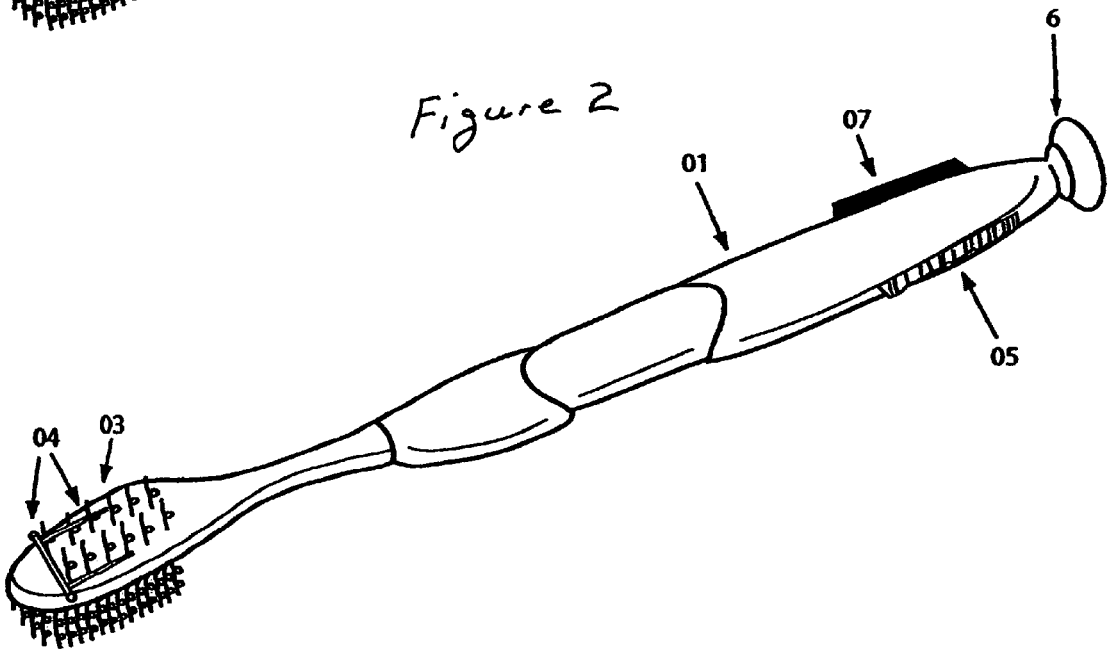
FIG. 2 is a rear perspective view of the tooth brush of the invention with the flossing element in the storage position.

The base handle (01) of the device has a contour flair for easy use whether you are male or female or a child to provide a universal hand grip for the device. The tongue cleaner (02) area is on top side of a tooth brush head (12) at the very end of the handle, far away from the section that would go in the user's mouth. The brush head area also holds the flossing device (03) bracket that can remain very clean by being tucked away and stored (as shown in FIG. 2) alongside the tongue cleaning bristles (02), never interfering with the operation of cleaning ones mouth via the tongue cleaner or tooth brushing bristles.

The tongue cleaner is made of vertical spring shaped bristles (02). Such a shape allows for better penetration for scrubbing and lifting debris from the tongue. On the underside of the brush head, on the opposite face from the tongue cleaner are the spring shaped bristles (04) with the spike ends configured to be the teeth brushing bristles of the device. Such a shape facilitates a more thorough cleaning effect that can more effectively scrape debris for removal. Further, the spring shape allows for the bristles to be less densely packed on the brush head as conventional bristles, reducing the chance for trapped food particles between bristles.

Holding devices (05, 6, 07) are located at the end of the handle furthest from the brush head allow the device to be stored upright on a surface. This will prevent the wet handle of the device to drip onto the portion of the device to be inserted into the mouth and allow such moisture to dry in a more sanitary fashion. Such securing means are a magnet (05), hook and loop fasteners (07) and a suction cup (06). Additionally, such securing means mean purchasing a separate toothbrush holder is unnecessary.

Figure 1:
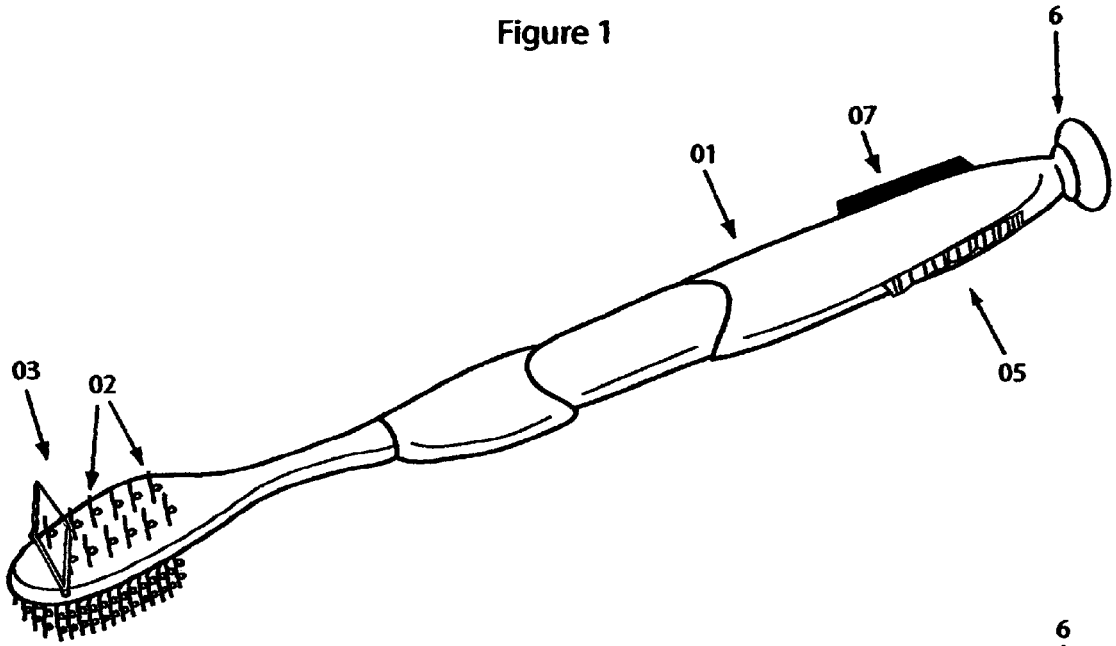
FIG. 1 is a rear perspective view of the tooth brush of the invention with the flossing element in the flossing position.

The floss holding device (03) is removably secured to the tooth brush head (03) on the same face as the tongue cleaner and has clips that will simply just snap into the tooth brush head providing an easy to remove and disposable flossing device bracket to be replaced after many uses. The floss holding device has a straight bar connecting two parallel arms that will simply just snap in to place on both sides of the tooth brush. The floss holding device is rotatably secured to the brush head between a storage position (FIG. 2) and a flossing position (FIG. 1). A snap lock mechanism keeps the holding device securely held in each respective position; however can be alternated via an amount of force to overcome the positioning lock.

The arms of the floss holding device removably secure a length of floss in between so that the user can replace worn/dirty floss quickly and easily as needed. Such a securing can be achieved via slits in the arms.

Since the flossing element can be placed in a storage configuration when not in use, there is no chance of the flossing element being lost when not in use.

Optionally, the toothbrush can be provided with dehydrated or condensed toothpaste embedded on the brush. Such a feature can be beneficial while camping, boating, in the military or when water is scarce. The conventional use of the device, bringing the brush head in the mouth in contact with the saliva will activate the toothpaste.

What is claimed is:

1. A tooth brushing combination device comprising:

a tooth brush having a brush head having a proximal end and a distal end that is connected to a distal end of a handle;

the brush head comprising vertical helical spring shaped bristles attached to one side of the brush head, configured to brush the teeth of the user;

a holding device located at a proximal end of the handle, remote from the brush head, the holding device configured to securely fasten the toothbrush vertically or horizontally onto a surface;

a tongue cleaner disposed on an opposing face of the brush head from said bristles, the tongue cleaner comprising vertical spring shaped spikes configured to clean debris from the tongue of the user; and a floss holding bracket detachably coupled to the opposing face of the brush head of the device at a distal end of the brush head, the floss holding bracket consisting of two support arms removably securing a length of floss in between; the floss holding bracket being attached to the brush head via a snap engagement and being rotatable between a storage position where the support arms lay flat along the brush head and a flossing position where the arms extend perpendicularly from the brush head and are snap locked to secure and maintain the arms in each respective position.

2. A tooth brushing combination device, as claimed in claim 1, wherein the holding device is selected from the group consisting of a magnet, hook-and-loop fasteners, and a suction cup.

* * * * *